US012024267B2

(12) United States Patent
Bardon

(10) Patent No.: US 12,024,267 B2
(45) Date of Patent: Jul. 2, 2024

(54) WATERSPORTS SYSTEM AND ASSEMBLY, METHOD OF MANUFACTURE AND DISMANTLING

(71) Applicant: Sealver, Sanguinet (FR)

(72) Inventor: Patrick Bardon, Sanguinet (FR)

(73) Assignee: Sealver, Sanguinet (FR)

( * ) Notice: Subject to any disclaimer, the term of this patent is extended or adjusted under 35 U.S.C. 154(b) by 454 days.

(21) Appl. No.: 17/298,590

(22) PCT Filed: Dec. 6, 2019

(86) PCT No.: PCT/EP2019/083937
§ 371 (c)(1),
(2) Date: May 30, 2021

(87) PCT Pub. No.: WO2020/115264
PCT Pub. Date: Jun. 11, 2020

(65) Prior Publication Data

US 2022/0009601 A1 Jan. 13, 2022

(30) Foreign Application Priority Data

Dec. 6, 2018 (FR) ..... 1872459

(51) Int. Cl.
*B63B 35/66* (2006.01)
*B63B 34/10* (2020.01)
*B63B 35/70* (2006.01)

(52) U.S. Cl.
CPC ..... *B63B 35/665* (2013.01); *B63B 35/70* (2013.01); *B63B 34/10* (2020.02)

(58) Field of Classification Search
CPC ..... B63B 35/665; B63B 35/70; B63B 34/10
See application file for complete search history.

(56) References Cited

U.S. PATENT DOCUMENTS 3,815,539 A 6/1974 Stevens
3,842,782 A 10/1974 Cuttica
5,255,625 A 10/1993 Hattori
5,353,730 A * 10/1994 Talbot ..... B63B 35/70 114/77 R
5,372,083 A * 12/1994 Hattori ..... B63B 35/00 114/248

(Continued)

FOREIGN PATENT DOCUMENTS

FR 2905351 A1 3/2008
FR 2921041 A1 * 3/2009 ..... B63B 35/665
WO 9622219 A1 7/1996

*Primary Examiner* — Anthony D Wiest
(74) *Attorney, Agent, or Firm* — IP Attorneys Group, LLC

(57) ABSTRACT

The watersports system comprises a floating, non-motorized watersports assembly (12) provided with an interface (30) for removable sealed assembly to a marine engine. The first floating watersports assembly includes an assembly interface (39) for assembly with a second floating watersports assembly. The watersports system comprises a second floating watersports assembly (14), comprising an assembly interface (37) for assembly with the first floating watersports assembly. Assembling the first floating watersports assembly and the second floating watersports assembly forms a second, floating craft (1) that can be sailed, propelled by an engine (2).

15 Claims, 5 Drawing Sheets

(56) References Cited

U.S. PATENT DOCUMENTS

| | | | | | |
|---|---|---|---|---|---|
| 5,605,110 | A | * | 2/1997 | Talbot | B63B 35/40<br>114/77 R |
| 5,775,250 | A | | 7/1998 | Kobayashi | |
| 6,035,796 | A | * | 3/2000 | Vowels | B63B 35/665<br>114/248 |

* cited by examiner

WATERSPORTS SYSTEM AND ASSEMBLY, METHOD OF MANUFACTURE AND DISMANTLING

FIELD OF THE INVENTION

The present invention relates to a nautical system, to a nautical assembly, and to methods of manufacturing and disassembling nautical systems.

TECHNOLOGICAL BACKGROUND

More specifically, the invention relates to a nautical system comprising a first, non-motorized, floating nautical assembly comprising a removable watertight interface for assembly to a personal watercraft (PWC), adapted so that an assembly of the first floating nautical assembly and the personal watercraft forms a first navigable floating watercraft propelled by a propulsion system of the personal watercraft.

In the field of boating, it is known from FR 2 921 041 how to make a modular floating boat by assembling a personal watercraft to a non-motorized floating nautical assembly. One can either use the personal watercraft on its own, or one can use it in combination with the floating nautical assembly, in which case more people or equipment can board the watercraft. FR 2 921 041 is concerned in particular with the modularity of the assembly of the floating watercraft assembly itself with different models of personal watercrafts.

Although the floating nautical assembly is floating, it is not motorized whenever it is not assembled to the personal watercraft, and therefore offers limited functionality.

It is also known from U.S. Pat. No. 5,255,625 to propose a non-motorized main boat that includes a mooring surface for receiving a smaller watercraft of the personal watercraft type. The assembly means between the main boat and the personal watercraft are removable and replaceable to accommodate different personal watercraft configurations.

However, in the absence of an attached personal watercraft, the main boat is, here again, not powered: it is not intended that the main boat can be used without an attached personal watercraft.

The invention aims to increase the modularity of nautical systems.

SUMMARY OF THE INVENTION

Thus, the invention relates to a nautical system which, in addition to the features presented above, has the following features:

- the first floating nautical assembly further comprises an interface for assembly to a second floating nautical assembly,
- and the nautical system further comprises a second floating nautical assembly, comprising an interface for assembly to the first floating nautical assembly, adapted so that an assembly of the first floating nautical assembly and the second floating nautical assembly forms a second navigable floating boat propellable by a motor that can be assembled to the second floating boat.

The second nautical assembly is to be understood as distinct from a personal watercraft in that it is floating as such, but not navigable: its stability when not assembled with the first nautical assembly is not guaranteed, and it is not intended to be capable of being used alone.

With these arrangements, the floating nautical assembly can be used either with a personal watercraft or with this second floating nautical assembly. Thus, the user has different options for boating.

Advantageously, the first nautical assembly comprises a first upper deck surface, the second nautical assembly comprises a second upper deck surface, and the second floating boat comprises a continuous deck surface formed by juxtaposing the first and second deck surfaces.

Thus, when the first and second boating assemblies are assembled, they together form a conventional boat, i.e. with a continuous deck surface for passengers, with the second assembly providing the power. In particular, passengers can move between the first nautical assembly and the second nautical assembly without directly perceiving that it is an assembly of the two.

According to different aspects, it is possible to provide for one and/or other of the following provisions.

According to one embodiment, the second floating nautical assembly comprises an operator's station comprising at least one driver's seat or console comprising means for maneuvering, and the operator's station comprises at least one upper surface at a different height from the second upper deck surface.

According to one embodiment, the first nautical assembly comprises a lower receiving portion, said lower receiving portion comprising an upwardly facing upper surface, and the second nautical assembly comprises a lower surface abutting the upper surface of the lower receiving portion of the first nautical assembly to form the second floating boat.

According to one embodiment, the lower receiving portion comprises two lateral sides connected to each other by a front portion.

According to one embodiment, the lower receiving portion comprises a continuous seal extending from a rear end of the first floating nautical assembly through the forward portion to a rear end of the first floating nautical assembly.

According to one embodiment, the assembly of the first floating nautical assembly and the second floating nautical assembly is a bolt-on.

According to one embodiment, the second nautical assembly comprises an opening for accessing an assembly system of the first floating nautical assembly and the second floating nautical assembly, the second nautical assembly further comprising a removable cover for closing the opening.

According to one embodiment, the first nautical assembly comprises a strap for holding the personal watercraft.

According to one embodiment, the nautical system further comprises at least one outboard motor that can be assembled to the second floating nautical assembly, so as to propel the second floating boat.

According to one embodiment, the nautical system comprises the first and second floating boating assemblies assembled.

According to one embodiment, the nautical system further comprises a personal watercraft, adapted to be assembled at the assembly interface to a watercraft of the first floating nautical assembly so as to form the first navigable floating watercraft propelled by a propulsion system of the personal watercraft.

According to one embodiment, the nautical system comprises the first floating nautical assembly and the assembled personal watercraft.

According to another aspect, the invention relates to a floating nautical assembly comprising all the features of the second floating nautical assembly of such a nautical system.

According to another aspect, the invention relates to a method of manufacturing a floating boat in which:

a first, non-motorized, floating nautical assembly is provided, including a removable watertight assembly interface to a personal watercraft, adapted so that an assembly of the first floating nautical assembly and the personal watercraft forms a first navigable floating boat propelled by a propulsion system of the personal watercraft, and including an assembly interface to a second floating nautical assembly, a second nautical assembly is provided, comprising an interface for assembly to the first floating nautical assembly, adapted so that an assembly of the first floating nautical assembly and the second floating nautical assembly forms a second navigable floating boat propellable by a motor that can be assembled to the second floating boat, the first nautical assembly and the second nautical assembly are assembled.

According to another aspect, the invention relates to a method for disassembling a floating boat, wherein:

a floating boat is provided comprising a first nautical assembly and a second nautical assembly assembled together, the first, non-motorized, floating nautical assembly including a removable watertight assembly interface to a personal watercraft, adapted so that an assembly of the first floating nautical assembly and the personal watercraft forms a first navigable floating boat propelled by a propulsion system of the personal watercraft, and including an assembly interface to a second floating nautical assembly the second nautical assembly comprising an interface for assembly to the first nautical assembly, adapted so that an assembly of the first nautical assembly and the second nautical assembly forms said navigable floating boat propellable by a motor that can be assembled to the second floating boat, the first and second floating watercraft assemblies are disassembled from each other.

BRIEF DESCRIPTION OF THE DRAWINGS

Embodiments of the invention will be described below while referring to the drawings, briefly described below.

In the drawings, identical numbers refer to identical or similar objects.

DETAILED DESCRIPTION

Figure 1:
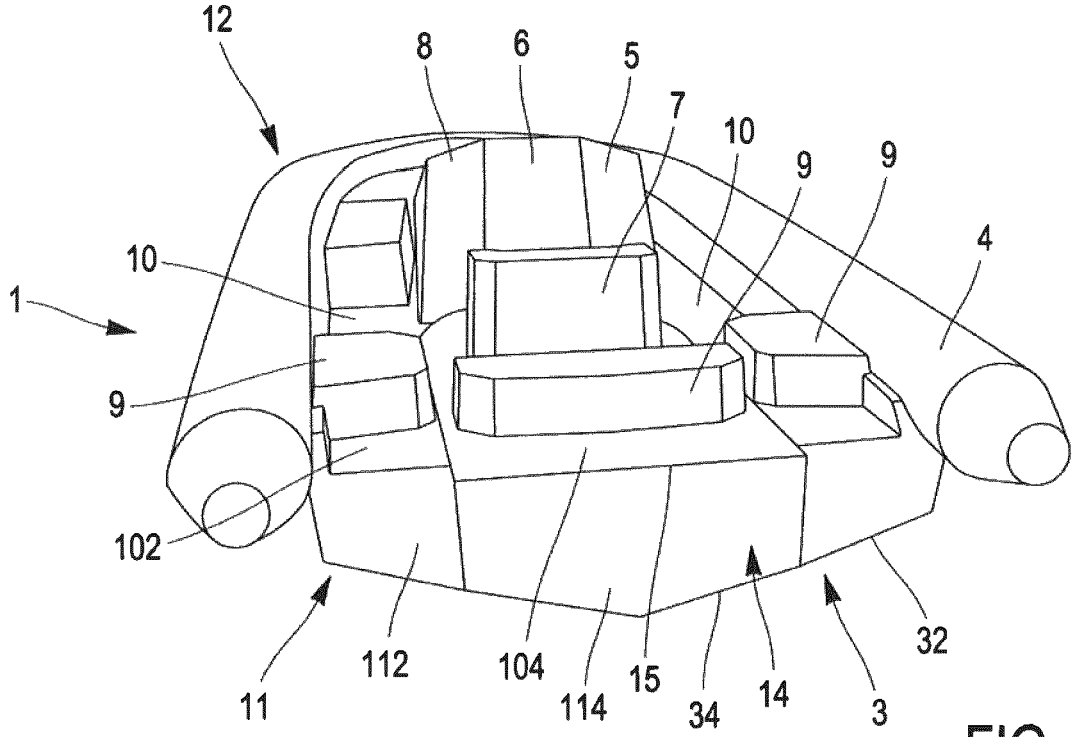
FIG. 1 shows a rear perspective view of a nautical system, in an assembled configuration.

FIG. 1 shows schematically a floating boat 1, according to a first embodiment.

The floating boat 1 is a self-contained floating system, which can be used to navigate for pleasure on a body of fresh water, or at sea near the coast.

For this system, where gravity plays an important role, the description of the system will be made in the context of normal use of the system, during navigation. The terms "high", "low", "upper", "lower" shall be used with consideration of the direction of gravity when so used. The floating boat 1 is propelled by a motor 2 (not shown in FIG. 1, see FIG. 5). The engine is typically arranged at the stern of the floating boat 1. The side of the floating boat 1 opposite the stern is the "bow". The floating boat 1 has two lateral sides extending from the rear to the front. The floating boat 1 has a streamlined shape for navigation. The floating boat 1 is substantially symmetrical with respect to a central rear-front axis.

The engine 2 may typically be an outboard engine 2, as shown. Alternatively, it can be an "in-board" engine, for example petrol or electric, driving a turbine, a "Z-drive" block or shaft line integrated into the floating boat.

In the example shown, the floating boat 1 is in the form of a so-called "semi-rigid" boat, i.e. a boat whose buoyancy is based both on a central rigid hull 3 and on a peripheral inflatable ring 4. The rigid hull 3 is for example made of plastic. Its lower portion is lower than the peripheral inflatable ring 4, so as to be partially submerged when the peripheral inflatable ring 4 is in contact with water.

The floating boat 1 comprises a central portion 11 on which the peripheral ring 4 is assembled. The lower portion of the central portion 11 constitutes the hull 3.

The floating boat 1 comprises an operator's station 5. The operator's station 5 is, for example, arranged in an intermediate region of the floating boat 1 in the fore-and-aft direction, as well as between the two lateral sides. The operator's station 5 comprises, for example, a console 6 carrying means for maneuvering and/or controlling the floating boat 1, in particular for steering it and/or for the power applied to the engine.

The operator's station 5 may also include a seat 7 for the operator of the floating boat 1. The seat 7 is located at the rear of the console 6.

The operator's station may also include a protection 8 for the operator of the floating boat 1. The protection 8 protects the operator from spray coming from the front of the floating boat 1 during navigation. The protection 8 is located inside the console 6. It is at least partially translucent.

The floating boat 1 may also include additional seats 9 for other passengers of the floating boat 1. The additional seats 9 may, for example, be arranged at the rear of the operator's station, at the sides at the rear and/or at the front (not shown).

The floating boat 1 has a deck surface 10. The deck surface 10 is the surface on which the passengers move around, when navigating by means of the floating boat 1. The deck surface 10 is formed by the upper part of the central portion 11. Apart from locations where it accommodates components of the marine system, such as seats for sitting, trunks for storing objects, security systems, . . . , the deck surface 10 tends to be, as far as possible, continuous, so as not to form an obstacle to the walking of passengers as they move about the deck surface. "Continuous" means that the deck surface is substantially smooth, with no roughness, steps or stalling, on the scale of a passenger's step. However, this does not necessarily mean that the deck surface is substantially flat, since it may be curved or domed.

According to the embodiment of FIG. 1, the floating boat 1 just described is made from two nautical assemblies assembled together. This means that all of the components and/or functions that have been described above can be distributed over the two nautical assemblies. The first nautical assembly 12 includes an interface 39 for assembly to the second nautical assembly 14.

In particular, in the example shown, a first nautical assembly 12 comprises a forward peripheral portion of the central portion 11 of the floating boat 1. In this example, since the front peripheral part of the central portion 11 of the floating boat 1 carries the peripheral inflatable ring 4, the latter also forms part of the first nautical assembly 12. The first nautical assembly 12 is shown in FIG. 2. The second nautical assembly 14 comprises a rear central portion of the floating boat 1. The second nautical assembly 12 is shown in FIGS. 3 and 4.

Each of the first and second boating assemblies 12 and 14 forms a self-contained watercraft element that is inherently buoyant. However, neither is configured for autonomous navigation. The assembled first and second boating assemblies 12 and 14 form a floating boat 1 configured for navigation. The assembly in question is watertight. More specifically, the first nautical assembly 12 is devoid of a motorized propulsion device, or at least a complete and functional such device. Furthermore, although the second nautical assembly 14 is inherently buoyant, it is not balanced to be navigable on its own, i.e., until it is assembled with the first assembly 12, it tends to capsize easily even under normal sailing conditions. In other words, the second nautical assembly 14 is not intended to be used alone.

Figure 3:
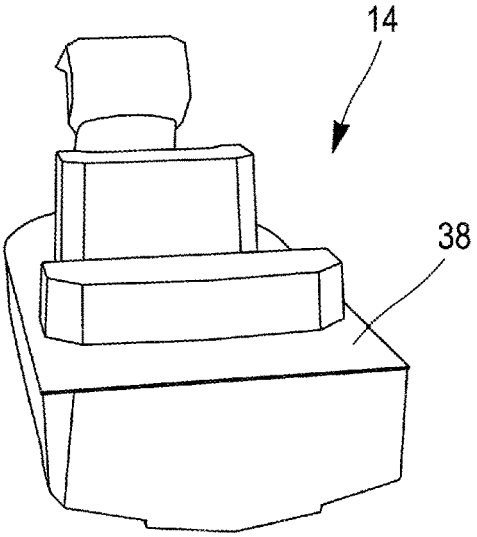
FIG. 3 is a perspective view, from the same perspective as FIG. 1, of a second nautical assembly of the nautical system of FIG. 1.
Figure 4:
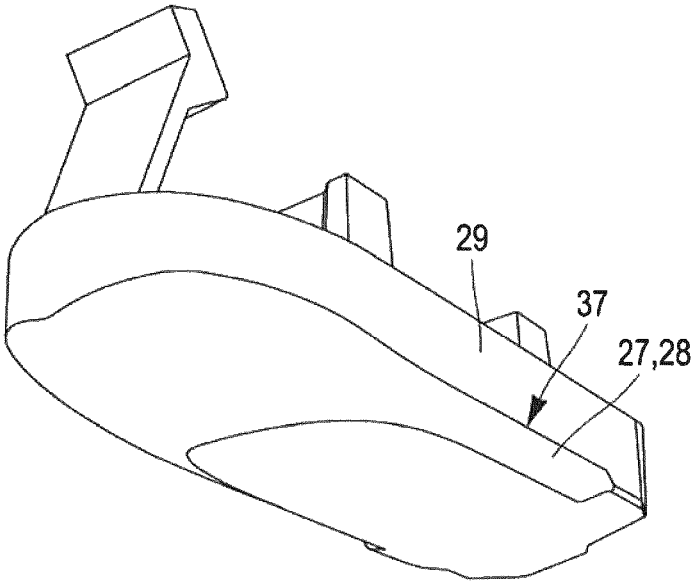
FIG. 4 is a perspective view from below of the second nautical assembly in FIG. 3.

As can be seen in particular from FIGS. 3 and 4, the second nautical assembly 14 is formed from the aft central portion of the floating boat 1. The term "central" refers to the position of the second nautical assembly 14 with respect to the side edges of the floating boat 1.

Accordingly, the second nautical assembly 14 forms a core. The first nautical assembly 12 has a cradle shape for receiving the core formed by the second nautical assembly 14. In particular, when viewed from above, the first nautical assembly 12 is C-shaped, with two side edges and a front, defining a central cavity for receiving the second nautical assembly 14.

Thus, the central portion 11 of the floating boat 1 is made in two parts. A first portion 112 is part of the first nautical assembly 12. A second part 114 is part of the second nautical assembly 14. The two parts are assembled together in a watertight manner, in a way that will be explained later, according to one embodiment, in relation to FIGS. 2 and 3.

The hull 3 of the floating boat 1 is made in two parts. A first part 32 is part of the first nautical assembly 12. A second part 34 is part of the second nautical assembly 14. The two parts 32 and 34 are in contact with the water during navigation. When the two parts 112 and 114 are assembled together, the two parts 32 and 34 are continuous and extend hydrodynamically from each other.

The deck surface 10 of the floating boat 1 is made in two parts. A first part 102 is part of the first nautical assembly 12. A second part 104 is part of the second nautical assembly 14. When the two parts 102 and 104 are assembled together, the top surfaces of the two parts 102 and 104 are continuously juxtaposed, and extend from each other.

Thus, when the first assembly 12 and the second assembly 14 are assembled, they form a conventional boat, with a substantially continuous deck surface 10 for a passenger moving between the first assembly 12 and the second assembly 14. The passenger does not have the direct perception that he or she is moving on an assembly of two assemblies.

The operator's station 5 can be made in two parts. For example, the console 6 and the driver's seat 7 may be part of the second nautical assembly 14. The protection 8 may form part of the first nautical assembly 12.

Alternatively (not shown), locally a portion of the second portion 104 of the deck surface may have a step or recess at a different height than the remainder of the upper surface of the deck surface. This makes it possible, for example, to adjust the position of a medium-sized navigator in relation to the elements of the operator's station. Thus, the elements of the first nautical assembly are adapted for navigation in a configuration assembled to the second nautical assembly as in a configuration assembled to a personal watercraft, discussed below.

In the case of an outboard motor, the second nautical assembly 14 comprises a receiving portion 15 of the outboard motor 2. The outboard motor 2, carried by the second nautical assembly 14, may be connected, if required, to the console 6, so that the outboard motor may be controlled from the console 6. This connection includes electrical and/or hydraulic connections. The outboard motor 2 is also fluidly connected to the fuel tank (not shown) of the second nautical assembly. Alternatively or additionally, the outboard motor 2 may be fluidly connected to a fuel tank (not shown) of the first nautical assembly. The second nautical assembly 14 may include significant reserve buoyancy to compensate for the overhang introduced by the outboard motor. The second nautical assembly 14, connected to the outboard motor, is floating. However, it is not very hydrodynamic. Alternatively, in the case of an integrated motor, a connection may be provided between it and a power source (fuel tank or battery) of the first nautical assembly 12.

The seats 9 may be divided between the first nautical assembly 12 (side seats) and the second nautical assembly 14 (rear centre seats).

Figure 2A:
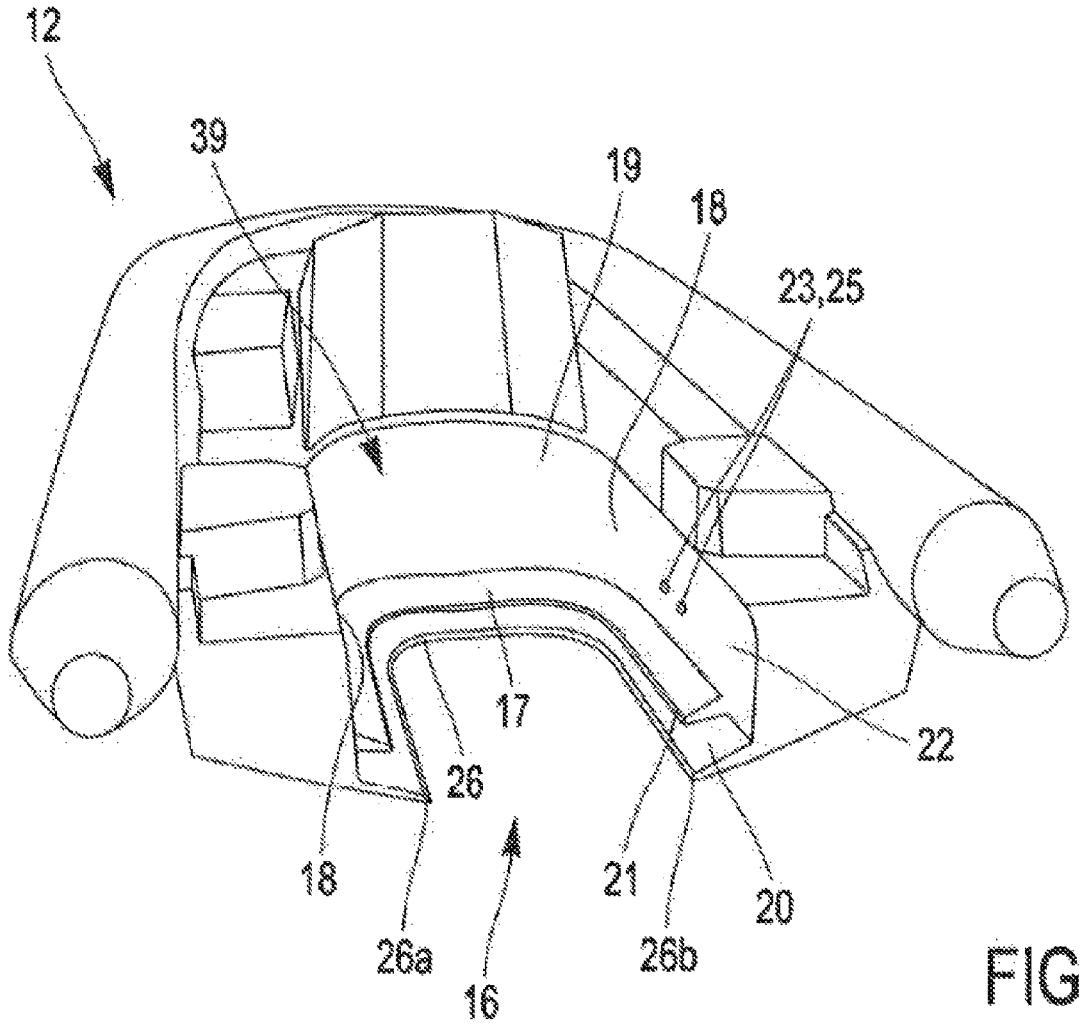
FIG. 2*a* is a perspective view, from the same perspective as FIG. 1, of a first nautical assembly of the nautical system of FIG. 1, in an assembly configuration to the second nautical assembly.

FIG. 2*a* illustrates in more detail the first nautical assembly 12, to which the second nautical assembly 14 is not assembled. The first nautical assembly 12 is floating. However, it is not very hydrodynamic. Moreover, it is not motorized.

The first nautical assembly 12 includes a lower receiving portion 16. The lower receiving portion 16 comprises an upper surface 17 facing upwards.

The lower receiving portion 16 comprises two lateral sides 18 connected by a front portion 19. Thus, the lower receiving portion 16, seen from above, is substantially C-shaped.

The lower receiving portion 16 comprises a lateral peripheral wall 22, substantially vertical. A substantially horizontal lowermost portion 20 extends radially centrally from the lateral peripheral wall 22. A shoulder 21, located above the lowermost portion 20, extends radially centrally from the lateral peripheral wall 22, and is less extensive than the lowermost portion 20.

The lower receiving portion 16 includes a continuous seal 26 extending from a rear end 26*a* of the first nautical assembly to a rear end 26*b* of the first floating assembly through the front portion 19 of the lower receiving portion 16.

In the configuration for assembly to the second nautical assembly 14, above the shoulder 21 on each lateral side, the assembly interface 39 to the second nautical assembly 14 comprises, for example, a fastening component 23 received on the lateral peripheral wall 22 of the lower receiving portion 16. In the purely illustrative example shown, the fastening component 23 forms part of the first part 112 of the central portion 11. The fastening component 23 may comprise a threaded hole 25. Several taps 25 can be made.

As seen in FIGS. 3 and 4, the second floating nautical assembly 14 includes an assembly interface 37 to the first nautical assembly 12. The assembly interface 37 includes a lower surface 27 abutting the upper surface 17 of the lower receiving portion 16 of the first floating nautical assembly 12.

The lower surface 27 is complementary in shape to the upper surface 17 of the lower receiving portion 16 of the first floating nautical assembly 12. For example, the bottom surface 27 includes a step 28 complementary in shape to the shoulder 21. The floating boat 1 is thus formed. During this assembly, the seal 26 is squeezed between the two boating assemblies 12 and 14 to assist in sealing between the two boating assemblies 12, 14.

The second nautical assembly 14 includes an outer peripheral surface 29, the side and front edges of which have a shape complementary to that of the lateral peripheral wall 22 of the first nautical assembly 12.

The assembly of the first floating nautical assembly 12 and the second floating nautical assembly 14 is a removable assembly. For example, it is a bolt-on. Upon assembly of the first nautical assembly 12 and the second nautical assembly 14, the second nautical assembly 14 is bolted to the first nautical assembly 12 via bolts of the second nautical assembly 14 secured in the threads 25 of the first nautical assembly 12. In this assembled configuration, the lower surface 27 of the second nautical assembly 14 rests on the upper surface 17 of the lower receiving portion 16 of the first nautical assembly 12 by crushing the seal 26, the outer peripheral surface 29 of the second nautical assembly 14 conforms to the lateral peripheral wall 22 of the first nautical assembly 12, and the first and second parts 102, 104 of the deck surface 10 are juxtaposed. A floating boat 1 is thus made, which is propellable by the motor that that can be assembled or is assembled to the second nautical assembly 14.

The second nautical assembly 14 may include an access opening to an assembly system of the first nautical assembly 12 and the second nautical assembly 14. The second nautical assembly 14 then includes a removable cover 38 for closing the opening.

The first nautical assembly 12 also includes an assembly interface 30 to a personal watercraft. It is a waterproof and removable assembly.

Figure 2B:
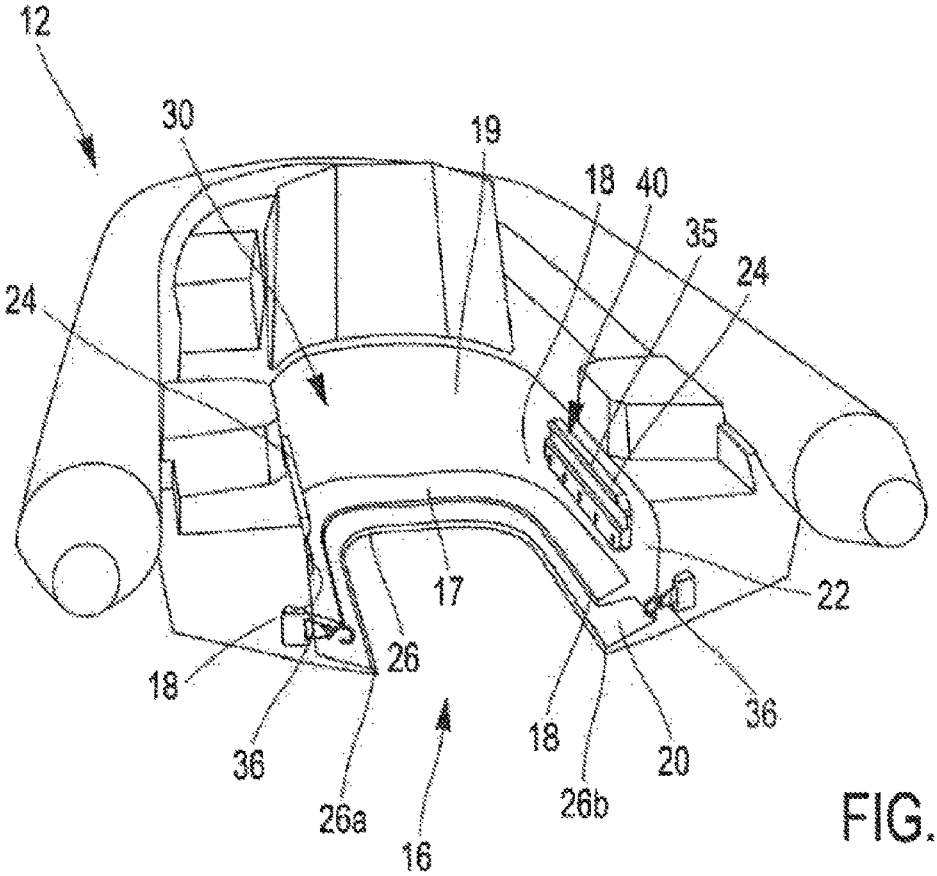
FIG. 2*b* is a perspective view, from the same perspective as FIG. 1, of a first nautical assembly of the nautical system of FIG. 1, in the configuration of assembly to a personal watercraft.

In FIG. 2*b*, the first nautical assembly 12 is shown in its assembly configuration to a personal watercraft. The assembly interface 30 to a personal watercraft may be received on the lower receiving portion 16. In the purely illustrative example shown, the assembly interface 30 to a personal watercraft includes a fastening system 40 that is received on the lateral peripheral wall 22 of the lower receiving portion 16. The fastening system 40 comprises housings 24 attached to the first part 112 of the central portion 11 on either side. If required, the housings 24 can be adapted to different types of personal watercrafts. The fastening system 40 also includes two deployable elastic straps 36. The straps 36 are arranged on either side of the central cavity at the rear, and can be deployed against a resilient biasing (rewinding) system. They can be fixed together, for example by means of end fittings.

Thus, the lower receiving portion 16 of the first nautical assembly 12 is adapted to receive both the assembly interface 39 to the second nautical assembly 14, in particular for the purpose of forming a continuous deck surface 10 as explained above, and the assembly interface 30 to a personal watercraft. Whether in either use, the first nautical assembly 12 retains the same characteristics, facilitating manufacture. For example, in the case where the first portion 32 of the central hull 3, i.e., the portion of the hull formed by the first nautical assembly 12, is manufactured by moulding, the mould remains the same whether for use with a second nautical assembly 14 or with a personal watercraft. Then, the type of assembly interface is mounted to the lower receiving portion 16 of the first nautical assembly 12 according to the intended application.

It is therefore possible to switch from one application to another, simply by changing the assembly interface. No modification of the structure of the first nautical assembly 12 is required.

This part will be described below also in relation to FIGS. 5 and 6, for a second embodiment, also transposable to the first embodiment described above.

Figure 5:
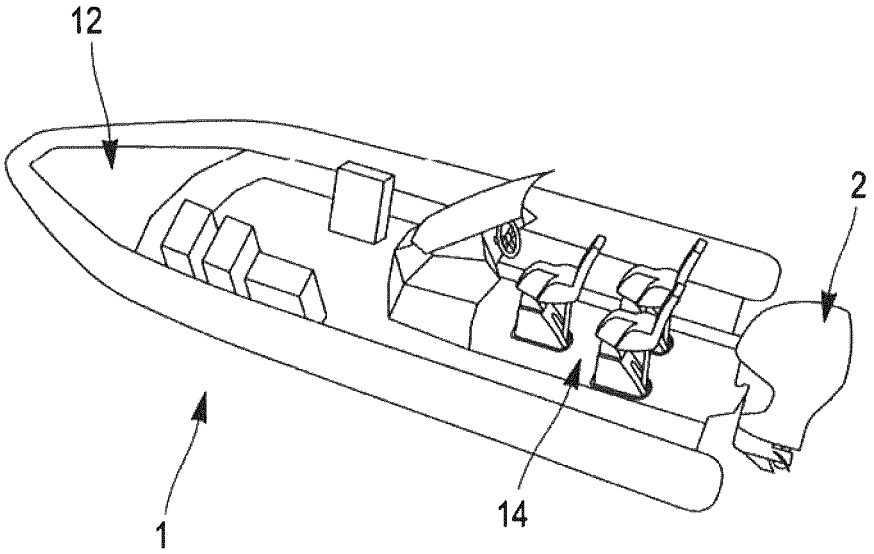
FIG. 5 is a side perspective view of a nautical system, in an assembled configuration, according to a second embodiment.

FIG. 5 thus presents another embodiment of a floating boat 1 obtained by assembling a first nautical assembly 12 and a second nautical assembly 14.

Figure 6:
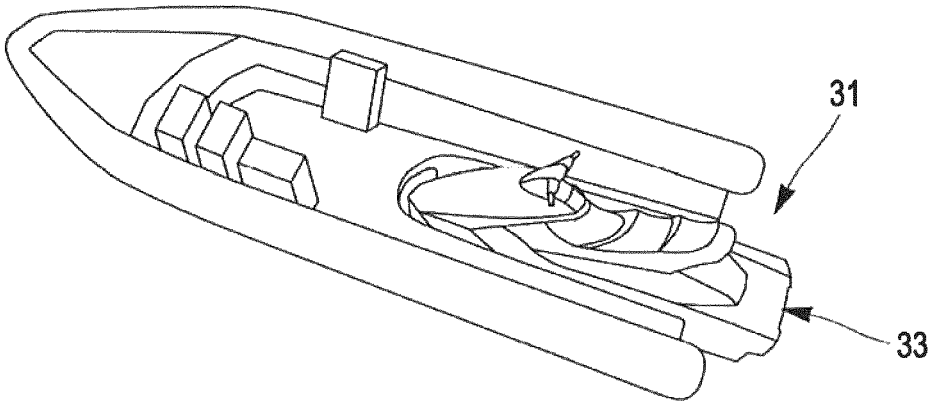
FIG. 6 is a perspective view, similar to FIG. 5, of the first nautical assembly of FIG. 5 assembled to a personal watercraft.

FIG. 6 shows another floating boat 31 obtained by assembling the first nautical assembly 12 of FIG. 5 and a personal watercraft 33. The floating boat 31 is propelled by the propulsion system of the personal watercraft 33.

The assembly between the first nautical assembly 12 and the personal watercraft 33 may be achieved by any means. To this end, the first nautical assembly 12 includes the assembly interface 30 to the personal watercraft 33.

For example, with further reference to FIG. 2*b*, the first nautical assembly 12 may be provided with personal watercraft guide rails 35. The rails 35 are arranged on the lateral peripheral wall 22 of the first nautical assembly 12, for example on both lateral sides. For example, a rail 35 is provided in the above-mentioned housing 24.

The first nautical assembly 12 also includes an elastic strap 36 (FIG. 2*b*), deployable at the rear of the personal watercraft 33, and resiliently biasing it forward. The protection 8 of the first nautical assembly 12 protects the user of the other floating boat 31 from spray generated while using the other floating boat 31.

The present invention therefore relates to a nautical system comprising the first nautical assembly 12 and the second nautical assembly 14, whether these are in an assembled to each other, or disassembled configuration. It also relates to such a nautical system, where the system also includes a personal watercraft 33, whether the personal watercraft is assembled to the first nautical assembly 12 (in which case the second nautical assembly 14 is necessarily disassembled therefrom) or disassembled (in which case the first nautical assembly 12 and the second nautical assembly 14 may or may not be assembled to each other). The present invention also relates to the first nautical assembly 12 or the second nautical assembly 14, taken separately, which are original products for implementing the above-described assemblies.

According to one aspect, the invention relates to a method of manufacturing a floating boat wherein:

the first nautical assembly 12 is provided, comprising a first assembly interface 30, the second nautical assembly 14 is provided, comprising a second assembly interface 37, the first nautical assembly 12 and the second floating nautical assembly 14 are assembled.

At the time of this assembly, the second nautical assembly 14 is already pre-assembled to the outboard motor 2. If applicable, the outboard motor has been previously assembled to the second nautical assembly 14, and the necessary electrical, hydraulic and fuel connections have been made. These steps of assembling the outboard engine 2 to the second nautical assembly 14 and the second nautical assembly 14 to the first nautical assembly 12 can be performed out of the water and in a workshop, for safety.

Once this assembly has been carried out, and the craft has been used, the invention also relates to a method of disassembling a floating craft 1, wherein:

a floating boat 1 is provided, comprising the first nautical assembly 12 and the second nautical assembly 14 assembled together, the first and second nautical assemblies 12, 14 are disassembled from each other.

This step of disassembling the second nautical assembly 14 and the first nautical assembly 12 can be performed out of the water and in a workshop, for safety. If applicable, upon completion of this disassembly, the first nautical assembly 12 is assembled with a personal watercraft 33 to form another floating watercraft.

Once this assembly has been carried out, and the boat has been used, the invention also relates to a method of disassembling this other floating boat.

The invention claimed is:

1. A nautical system comprising:

A first non-motorized, floating nautical assembly (12), —a removable watertight interface (30) for assembling the first floating nautical assembly to a personal watercraft, adapted so that the assembly of the first floating nautical assembly (12) and the personal watercraft forms a first navigable floating boat (31) propelled by a propulsion system of the personal watercraft, characterized in that the first floating nautical assembly (12) further comprises an interface (39) for assembling the first floating nautical assembly (12) to a second floating nautical assembly, in that the nautical system further comprises:

A second floating nautical assembly (14) which is not intended to be used alone, comprising an interface (37) for assembly to the first nautical assembly, adapted so that an assembly of the first nautical assembly (12) and the second nautical assembly (14) forms a second navigable floating boat (1) propellable by a motor (2) that can be assembled to the second floating boat (1), and in that the first nautical assembly (12) includes a first upper deck surface (102), wherein the second floating nautical assembly (14) comprises a second upper deck surface (104), and wherein the second floating boat (1) comprises a continuous deck surface (10) formed by the juxtaposition of the first and second deck surfaces (102, 104).

2. A nautical system according to claim 1, wherein the second floating nautical assembly (14) comprises an operator's station (5) comprising at least one driver's seat (7) or console (6) comprising means for maneuvering, and wherein the operator's station (5) comprises at least one upper surface at a different height from the second upper deck surface (104).

3. A nautical system according to claim 1, wherein the first floating nautical assembly (12) comprises a lower receiving portion (16), said lower receiving portion (16) comprising an upwardly facing upper surface (17), and wherein a second floating nautical assembly (14) comprises a lower surface (27) abutting the upper surface (17) of the lower receiving portion (16) of the first floating nautical assembly (12) to form the second floating boat (1).

4. A nautical system according to claim 3, wherein the lower receiving portion (16) comprises two lateral sides (18) connected together by a front portion (19).

5. A nautical system according to claim 4, wherein the lower receiving portion (16) comprises a continuous seal (26) extending from a rear end of the first floating nautical assembly (12) through the forward portion to a rear end of the first floating nautical assembly (12).

6. A nautical system according to claim 1, wherein the assembly of the first floating nautical assembly (12) and the second floating nautical assembly (14) is a bolt-on.

7. A nautical system according to claim 1, wherein the second nautical assembly (14) comprises an opening for access to an assembly system of the first floating nautical assembly (12) and the second floating nautical assembly (14), the second nautical assembly further comprising a removable cover (38) for closing the opening.

8. A nautical system according to claim 1, wherein the first nautical assembly (12) comprises a strap (36) to hold the personal watercraft.

9. A nautical system according to claim 1, further comprising at least one outboard motor (2) that can be assembled to the second floating nautical assembly (14), so as to propel the second floating boat (1).

10. A nautical system according to claim 1, comprising the first and second floating nautical assemblies (12, 14) assembled.

11. A nautical system according to claim 1, further comprising:

a personal watercraft (33), adapted to be assembled at the assembly interface to a personal watercraft of the first floating nautical assembly (12) so as to form the first navigable floating boat (31) propelled by a propulsion system of the personal watercraft.

12. A nautical system according to claim 11, comprising the first floating nautical assembly (12) and the assembled personal watercraft (33).

13. A nautical system according to claim 1, further comprising the second floating nautical assembly.

14. A method of manufacturing a floating boat (1) wherein:

a first, non-motorized, floating nautical assembly (12) is provided, comprising a removable watertight interface for assembly to a personal watercraft, adapted so that an assembly of the first floating nautical assembly (12) and the personal watercraft forms a first navigable floating watercraft propelled by a propulsion system of the personal watercraft, and including an interface for assembly to a second floating nautical assembly, a second floating nautical assembly (14) which is not intended to be used alone is provided, comprising an interface for assembly to the first nautical assembly, adapted so that an assembly of the first nautical assembly and the second nautical assembly forms a second motor-propelled navigable floating boat that can be assembled to the second floating boat, wherein the first nautical assembly (12) comprises a first upper deck surface (102), and the second floating nautical assembly (14) comprises a second upper deck surface (104), and wherein the first nautical assembly (12) and the second nautical assembly (14) are assembled, forming a continuous deck surface (10) formed by the juxtaposition of the first and second deck surfaces (102, 104).

15. A method of disassembling a floating boat (1), wherein:

a floating boat (1) is provided, comprising a first nautical assembly (12) and a second nautical assembly (14) assembled together, the second nautical assembly (14) not being intended to be used alone, the first nautical assembly (12) comprising a first upper deck surface (102), and the second nautical assembly (14) comprising a second upper deck surface (104), the first non-motorized, floating nautical assembly (12) including a removable watertight interface for assembly to a personal watercraft, adapted so that an assembly of the first floating nautical assembly and the personal watercraft forms a first navigable floating boat propelled by a propulsion system of the personal watercraft, and comprising an interface for assembly to a second floating nautical assembly the second floating nautical assembly (14) comprising an interface for assembly to the first floating nautical assembly adapted so that an assembly of the first nautical assembly and the second nautical assembly forms said motor propellable seaworthy floating boat that can be assembled to the second floating boat, and forms a continuous deck surface (10) formed by the juxtaposition of the first and second deck surfaces (102, 104), the first and second floating nautical assemblies (12, 14) are disassembled from each other.

* * * * *